US008281880B2

(12) United States Patent
Hall et al.

(10) Patent No.: US 8,281,880 B2
(45) Date of Patent: Oct. 9, 2012

(54) EXPANDABLE TOOL FOR AN EARTH BORING SYSTEM

(76) Inventors: David R. Hall, Provo, UT (US); Scott S. Dahlgren, Alpine, UT (US); Jonathan Marshall, Provo, UT (US)

( * ) Notice: Subject to any disclaimer, the term of this patent is extended or adjusted under 35 U.S.C. 154(b) by 73 days.

(21) Appl. No.: 12/836,564

(22) Filed: Jul. 14, 2010

(65) Prior Publication Data

US 2012/0012397 A1 Jan. 19, 2012

(51) Int. Cl.
*E21B 10/32* (2006.01)

(52) U.S. Cl. ..... 175/284; 175/281

(58) Field of Classification Search ..... 175/272, 175/284, 263, 281; 166/55.6
See application file for complete search history.

(56) References Cited

U.S. PATENT DOCUMENTS

| | | | | |
|---|---|---|---|---|
| 1,921,135 | A | 8/1933 | Santiago | |
| 2,170,452 | A | 8/1939 | Grant | |
| 2,427,052 | A | 9/1947 | Grant | |
| 3,126,065 | A | 3/1964 | Chadderdon | |
| 3,703,104 | A | 11/1972 | Tamplen | |
| 3,823,773 | A | 7/1974 | Nutter | |
| 3,986,554 | A | 10/1976 | Nutter | |
| 4,081,042 | A | 3/1978 | Johnson | |
| 4,491,187 | A | 1/1985 | Russell | |
| 4,655,289 | A | 4/1987 | Schoeffler | |
| 4,895,214 | A | 1/1990 | Schoeffler | |
| 5,230,390 | A | 7/1993 | Zastresek | |
| 5,316,094 | A | 5/1994 | Pringle | |
| 5,499,687 | A | 3/1996 | Lee | |
| 5,553,678 | A | 9/1996 | Barr | |
| 5,609,178 | A | 3/1997 | Hennig | |
| 5,673,763 | A | 10/1997 | Thorp | |
| 5,685,379 | A | 11/1997 | Barr | |
| 5,695,015 | A | 12/1997 | Barr | |
| 5,706,905 | A | 1/1998 | Barr | |
| 5,730,222 | A | 3/1998 | Rike | |
| 5,803,185 | A | 9/1998 | Barr | |
| 6,003,606 | A | 12/1999 | Moore et al. | |
| 6,089,323 | A | 7/2000 | Newman et al. | |
| 6,089,332 | A | 7/2000 | Barr | |
| 6,142,250 | A | 11/2000 | Griffin | |
| 6,717,283 | B2 | 4/2004 | Skinner | |
| 6,732,817 | B2 | 5/2004 | Dewey | |
| 6,854,953 | B2 | 2/2005 | Van Drentham-Susman | |
| 7,036,611 | B2 | 5/2006 | Radford | |
| 7,048,078 | B2 | 5/2006 | Dewey | |
| 7,252,163 | B2 * | 8/2007 | Ollerenshaw et al. | 175/269 |
| 7,275,593 | B2 | 10/2007 | Bloom et al. | |
| 7,308,937 | B2 | 12/2007 | Radford | |
| 7,314,099 | B2 | 1/2008 | Dewey et al. | |
| 7,665,550 | B2 * | 2/2010 | Rives | 175/406 |
| 7,891,441 | B2 * | 2/2011 | Lee | 175/267 |
| 2005/0145417 | A1 | 7/2005 | Radford | |
| 2007/0163808 | A1 * | 7/2007 | Campbell et al. | 175/57 |
| 2008/0105464 | A1 | 5/2008 | Radford | |
| 2008/0128175 | A1 | 6/2008 | Radford et al. | |
| 2010/0276201 | A1 * | 11/2010 | Makkar et al. | 175/57 |

* cited by examiner

*Primary Examiner* — Daniel P Stephenson
(74) *Attorney, Agent, or Firm* — Philip W. Townsend, III

(57) ABSTRACT

In one aspect of the present invention an expandable tool for an earth boring system comprises a mandrel comprising a tubular body and an outer diameter, a plurality of blades disposed about the outer diameter, and a slidable sleeve positioned around the outer diameter and capable of manipulating the plurality of blades into collapsed and expanded positions.

19 Claims, 13 Drawing Sheets

EXPANDABLE TOOL FOR AN EARTH BORING SYSTEM

BACKGROUND OF THE INVENTION

The present invention relates to the fields of downhole oil, gas and/or geothermal exploration and more particularly to the fields of expandable tools for downhole exploration. There exists in the art a variety of expandable tools used to enlarge the diameter of a wellbore and/or to stabilize a drill string during drilling operations. Expandable tools of this type may contain arms or blades which extend from the sides of a drill string and contact an earthen formation. Examples of these types of expandable tools are described in the following prior art documents.

One such expandable tool is disclosed in U.S. Pat. No. 7,314,099 to Dewey et al., which is herein incorporated by reference for all that it contains. Dewey et al. discloses an expandable downhole tool comprising a tubular body having an axial flowbore extending therethrough, at least one moveable arm, and a selectively actuatable sleeve that prevents or allows the at least one moveable arm to translate between a collapsed position and an expanded position. A method of expanding the downhole tool comprises disposing the downhole tool within the wellbore, biasing the at least one moveable arm to a collapsed position corresponding to an initial diameter of the downhole tool, flowing a fluid through an axial flow bore extending through the downhole tool while preventing the fluid from communicating with a different flowpath of the downhole tool, allowing the fluid to communicate with the different flowpath by introducing an actuator into the wellbore, and causing the at least one moveable arm to translate to an expanded position corresponding to an expanded diameter of the downhole tool.

Another such expandable tool is disclosed in U.S. Pat. App. 2008/0128175 to Radford et al., which is herein incorporated by reference for all that it contains. Radford et al. discloses an expandable reamer apparatus for drilling a subterranean formation including a tubular body, one or more blades, each blade positionally coupled to a sloped track of the tubular body, a push sleeve and a drilling fluid flow path extending through an inner bore of the tubular body for conducting drilling fluid therethrough. Each of the one or more blades includes at least one cutting element configured to remove material from a subterranean formation during reaming. The push sleeve is disposed in the inner bore of the tubular body and coupled to each of the one or more blades so as effect axial movement thereof along the track to an extended position responsive to exposure to a force or pressure of drilling fluid in the flow path of the inner bore.

BRIEF SUMMARY OF THE INVENTION

In one aspect of the present invention an expandable tool for an earth boring system comprises a mandrel comprising a tubular body and an outer diameter, a plurality of blades disposed about the outer diameter, and a slidable sleeve positioned around the outer diameter and capable of manipulating the plurality of blades into collapsed and expanded positions.

The slidable sleeve may comprise a plurality of interchangeable sections which may combine to form a complete toroid around the outer diameter of the mandrel. The slidable sleeve may manipulate the plurality of blades by translating axially or rotating around the mandrel.

The plurality of blades may partially wrap around a plurality of fins which may extend from the outer diameter of the mandrel. The plurality of blades may comprise a plurality of cutters spaced along a curve such as a swept curve and disposed on at least one leading edge. At least one blade of the plurality of blades may comprise an initial impact zone comprising a larger exposed surface area than a subsequent impact zone. An extra leading edge may be disposed on the larger exposed surface area of the initial impact zone on at least one blade of the plurality of blades.

At least one blade of the plurality of blades may comprise a flat edge or traction edges to engage an earthen formation to stabilize or immobilize the mandrel.

A first ridge may be disposed on an external surface of at least one blade of the plurality of blades and may come into contact with a second ridge disposed on an interior surface of the slidable sleeve. The first ridge and the second ridge may stop further expansion of the plurality of blades when the plurality of blades are in the expanded positions.

A plurality of channels may be disposed on interior and exterior surfaces of at least one blade of the plurality of blades and may comprise a buttress thread geometry. The plurality of channels on the interior surface of at least one blade of the plurality of blades may mate with a plurality of channels disposed on at least one fin of the plurality of fins. The plurality of channels disposed on the interior surface of at least one blade of the plurality of blades and the plurality of channels disposed on at least one fin of the plurality of fins may be angled between 10 and 30 degrees with respect to an axis of the mandrel in order to control the rate at which the plurality of blades expand axially.

A plurality of channels on the exterior surface of at least one blade of the plurality of blades may mate with a plurality of channels disposed on the slidable sleeve. The plurality of channels disposed on the exterior surface of at least one blade of the plurality of blades and the plurality of channels disposed on the slidable sleeve are angled between 70 and 110 degrees with respect to an axis of the mandrel in order to control the rate at which the plurality of blades expand radially.

A wedge may be formed between the plurality of channels disposed on at least one fin of the plurality of fins and a plurality of channels disposed on the slidable sleeve when at least one of the plurality of blades are in an expanded position.

The plurality of channels on the interior surface of at least one blade of the plurality of blades and the plurality of channels on at least one fin of the plurality of fins may engage and the plurality of channels on the exterior surface of at least one blade of the plurality of blades and the plurality of channels on the slidable sleeve may engage when the slidable sleeve manipulates the plurality of blades.

DETAILED DESCRIPTION OF THE INVENTION AND THE PREFERRED EMBODIMENT

Figure 1:
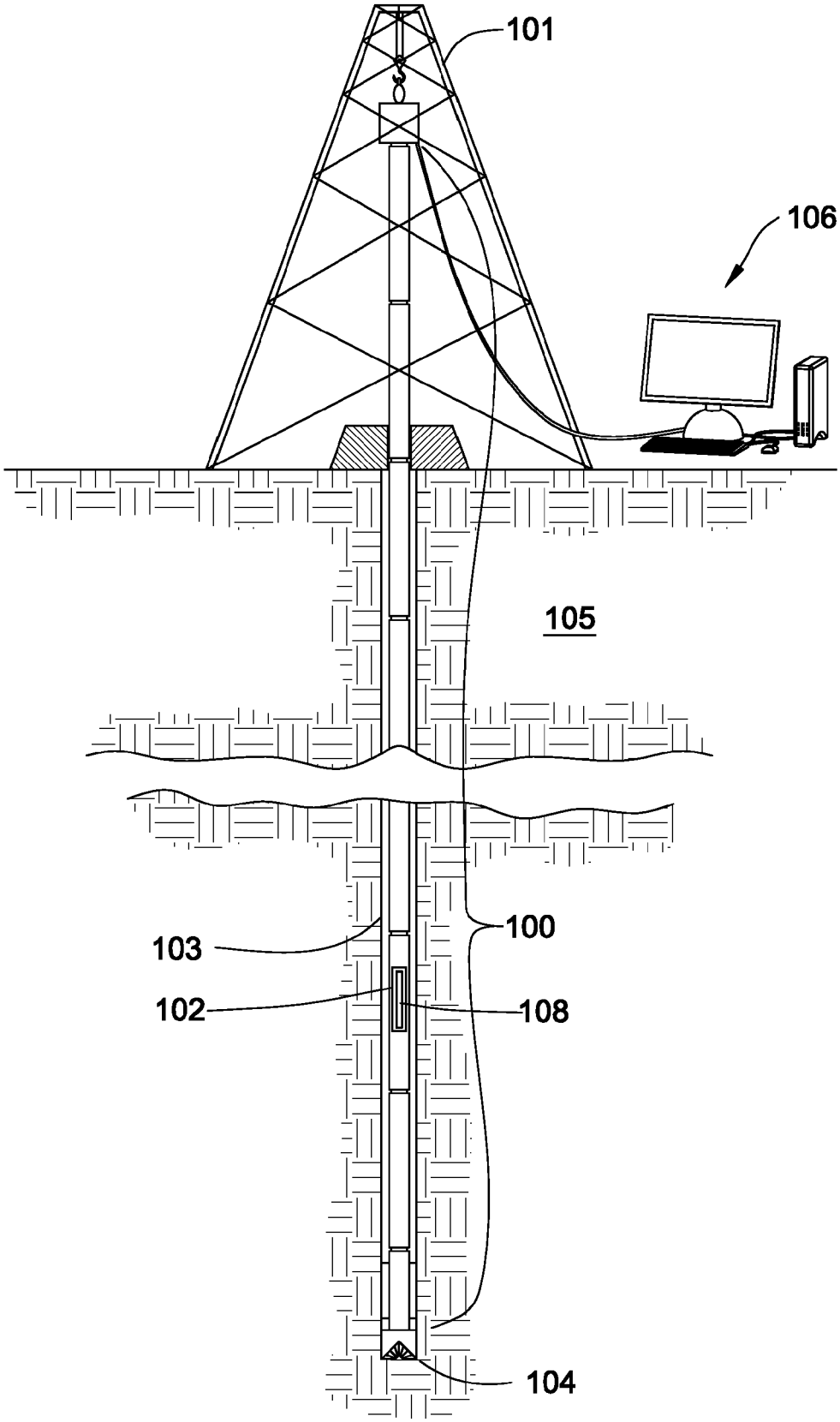
FIG. 1 is a cutaway view of an embodiment of a drilling operation.

Referring now to the figures, FIG. 1 discloses a cutaway view of an embodiment of a drilling operation comprising a drilling derrick 101 supporting a drill string 100 inside a borehole 103. The drill string 100 may comprise a drill bit 104. The drill string 100 may also comprise one or more downhole components 102. In this embodiment, the one or more downhole components 102 may comprise an expandable tool 108 used for enlarging the borehole 103 or stabilizing the drill string 100 in an earthen formation 105. The downhole drill string 100 may comprise electronic equipment able to send signals through a data communication system to a computer or data logging system 106 located at the surface.

Figures 2A, 2B:
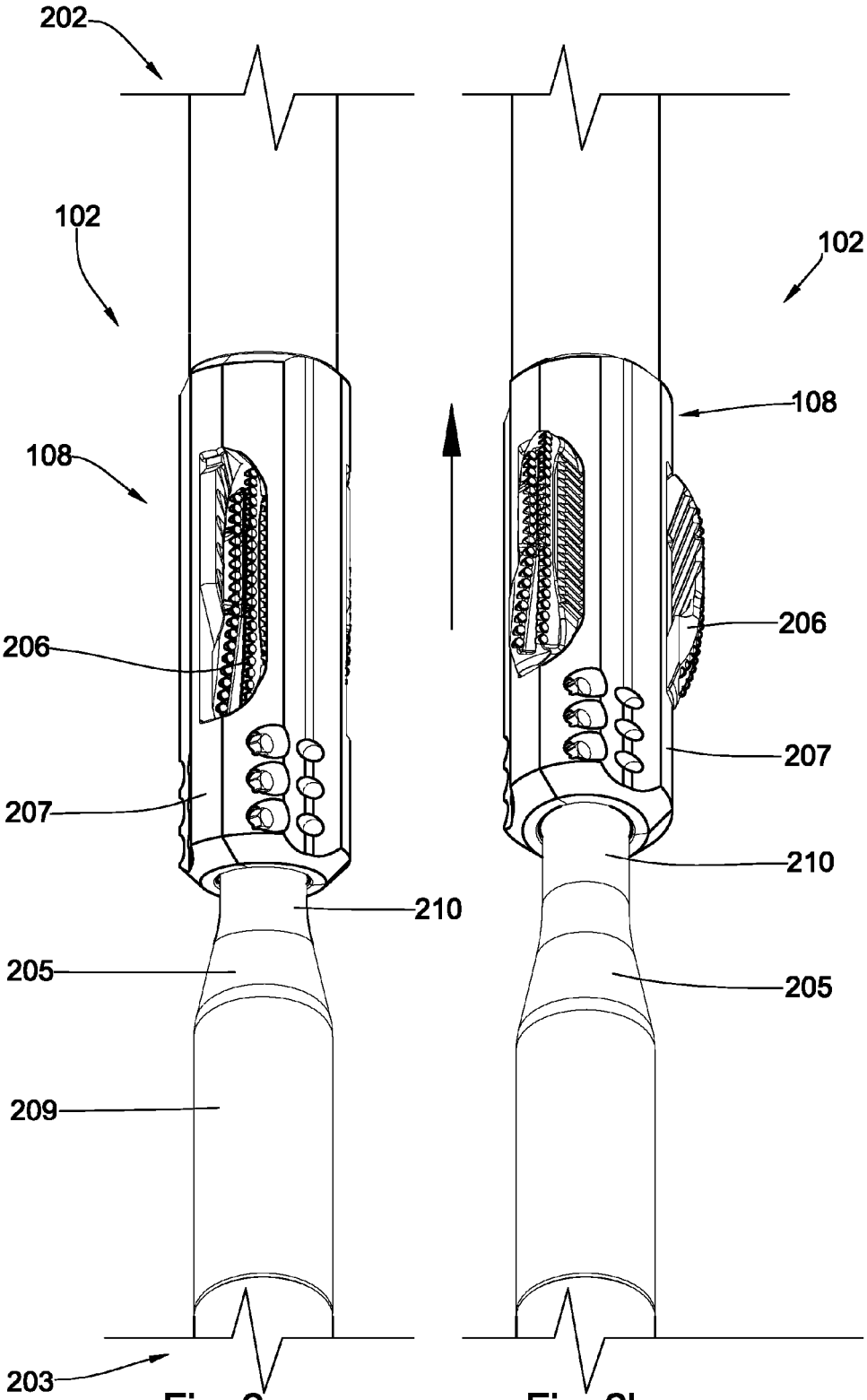
FIG. 2*a* is a perspective view of an embodiment of a downhole tool.
FIG. 2*b* is a perspective view of another embodiment of a downhole tool.

FIG. 2*a* discloses a perspective view of an embodiment of the downhole component 102 with a first end 202 and a second end 203. The first end 202 may connect to a portion of the drill string that extends to the surface of the borehole. The second end 203 may connect to a bottom hole assembly, drill bit, or other drill string segments. The downhole component 102 may comprise an expandable tool 108. In this embodiment, the expandable tool 108 may comprise a mandrel 205 comprising a tubular body 209 and an outer diameter 210, a plurality of blades 206 disposed about the outer diameter 210, and a slidable sleeve 207. The slidable sleeve 207 may also be disposed about the outer diameter 210 and may be capable of manipulating the plurality of blades 206 into collapsed and expanded positions. This embodiment shows the plurality of blades 206 in a collapsed position. When the plurality of blades 206 are in a collapsed position the downhole component 102 may rotate freely within a borehole.

FIG. 2*b* discloses a perspective view of an embodiment of the downhole component 102 which may comprise an expandable tool 108. The slidable sleeve 207 may manipulate the plurality of blades 206 by translating axially along the mandrel 205. The slidable sleeve 207 and the plurality of blades 206 may be connected such that as the slidable sleeve 207 translates along the mandrel 205, the plurality of blades 206 move into an expanded position. When the plurality of blades 206 are in an expanded position they may become engaged with an earthen formation.

Figure 3:
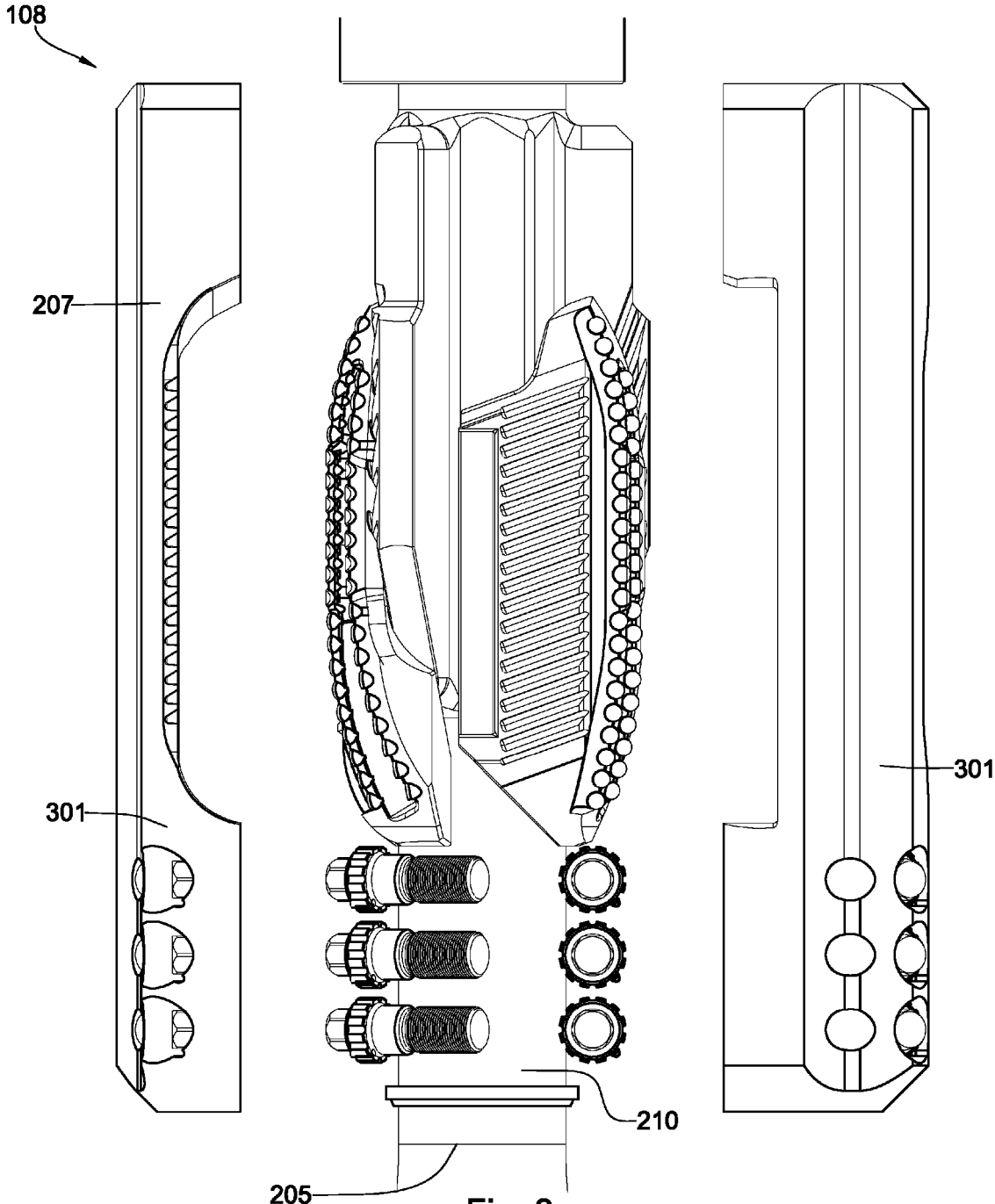
FIG. 3 is an exploded view of an embodiment of a downhole tool.

FIG. 3 discloses an exploded view of an embodiment of the downhole tool 108. The slidable sleeve 207 may comprise a plurality of interchangeable sections 301 which may combine to form a complete toroid around the outer diameter 210 of the mandrel 205.

Figure 4:
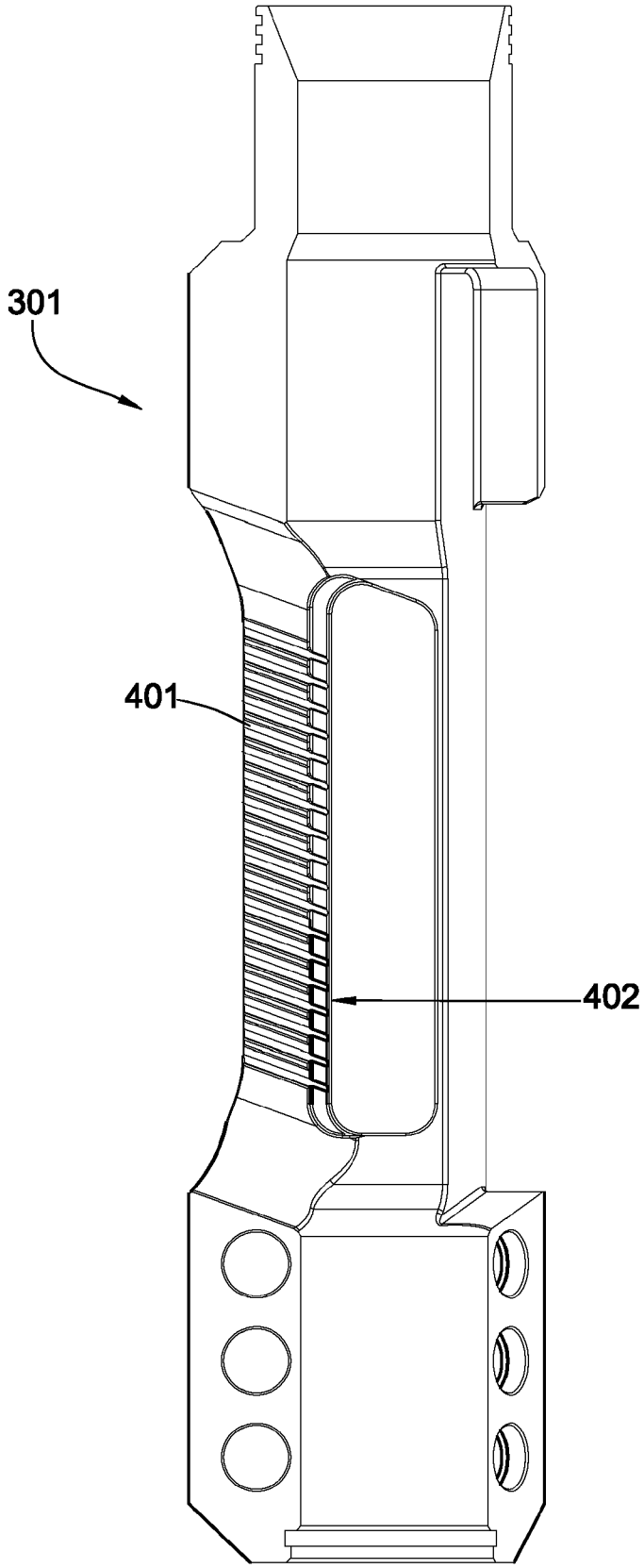
FIG. 4 is an orthogonal view of an embodiment of an interior surface of a section of a slidable sleeve.

FIG. 4 discloses an orthogonal view of an embodiment of an interior surface of an interchangeable section 301 of a slidable sleeve. The interchangeable section 301 may comprise a plurality of channels 401 disposed on the interior surface of the interchangeable section 301. The plurality of channels 401 may mate with a plurality of channels disposed on an exterior surface of at least one blade of the plurality of blades. The interior surface of the interchangeable section 301 may also comprise a first ridge 402. The first ridge 402 may come into contact with a second ridge disposed on an external surface of at least one blade of the plurality of blades when the at least one blade is expanding. The contact between the first ridge 402 and the second ridge may stop the further expansion of the at least one blade.

Figure 5:
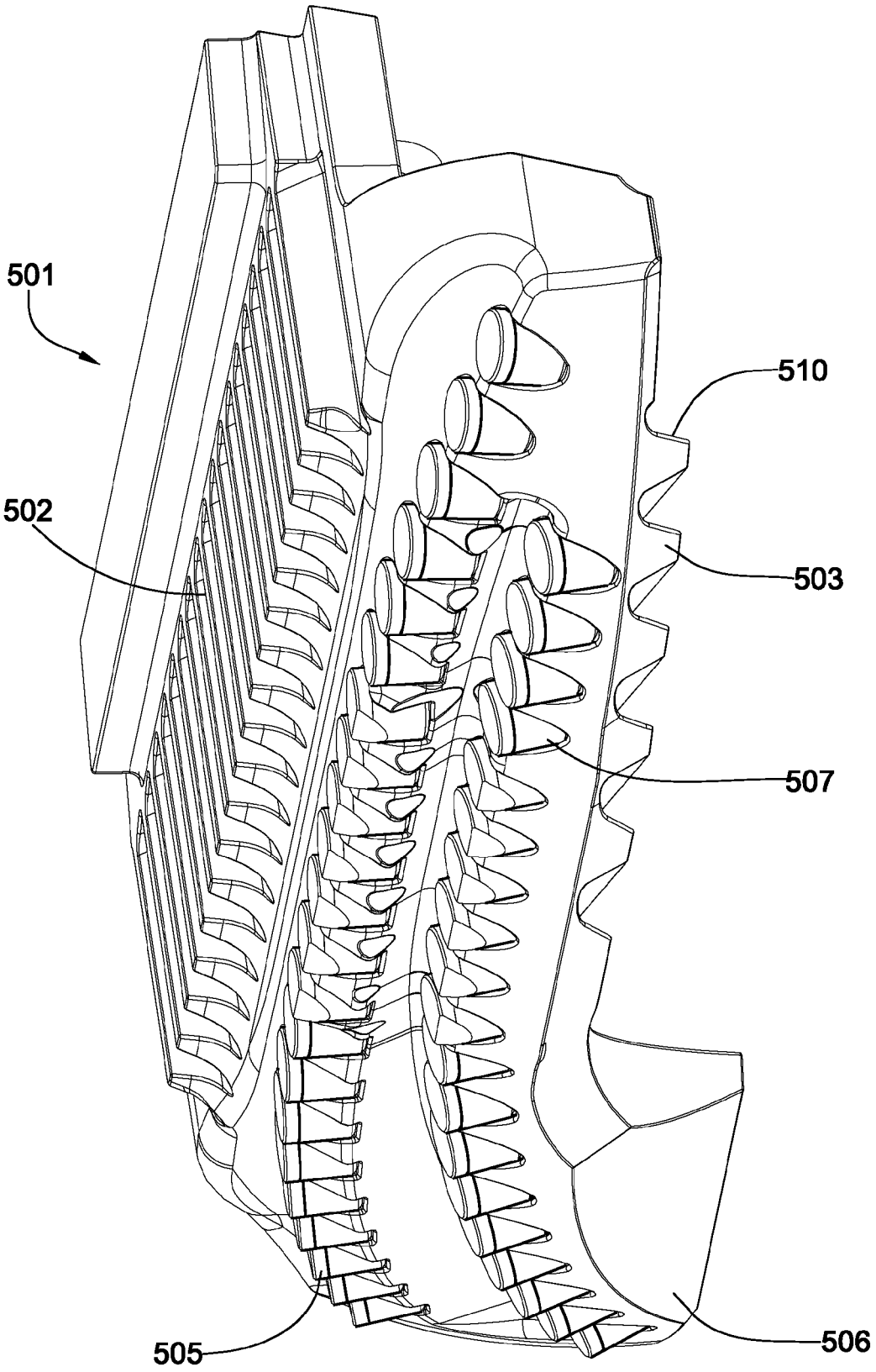
FIG. 5 is a perspective view of an embodiment of a blade of the plurality of blades.

FIG. 5 discloses a perspective view of an embodiment of a blade 501 of the plurality of blades. The external surface of the blade 501 may comprise a plurality of channels 502. The plurality of channels 502 disposed on the external surface of the blade 501 may mate with the plurality of channels disposed on an interior surface of an interchangeable section of the slidable sleeve. The internal surface of the blade 501 may comprise a plurality of channels 503. The plurality of channels 503 disposed on the interior surface of the blade 501 may mate with a plurality of channels disposed on an at least one fin of a plurality of fins disposed on the mandrel.

The plurality of channels 502 disposed on the external surface of the blade 501 and the plurality of channels 503 disposed on the internal surface of the blade 501 may comprise a buttress thread geometry. The buttress thread geometry may comprise a flat side 510 which may redirect forces caused by stress to align axially, or normal to the flat side 510. It is believed that the buttress thread geometry is advantageous over an Acme or trapezoidal type thread geometry because stress related forces are aligned axially with a buttress geometry rather than partially radially.

Also in this embodiment, the blade 501 may comprise a plurality of cutters 505 disposed along a curve, such as a swept curve, and disposed on at least one leading edge. The plurality of cutters 505 may be disposed along a swept curve due to the shape of the blade 501. The blade 501 may comprise an initial impact zone 506 which comprises a larger exposed surface area than a subsequent impact zone 507.

Figure 6:
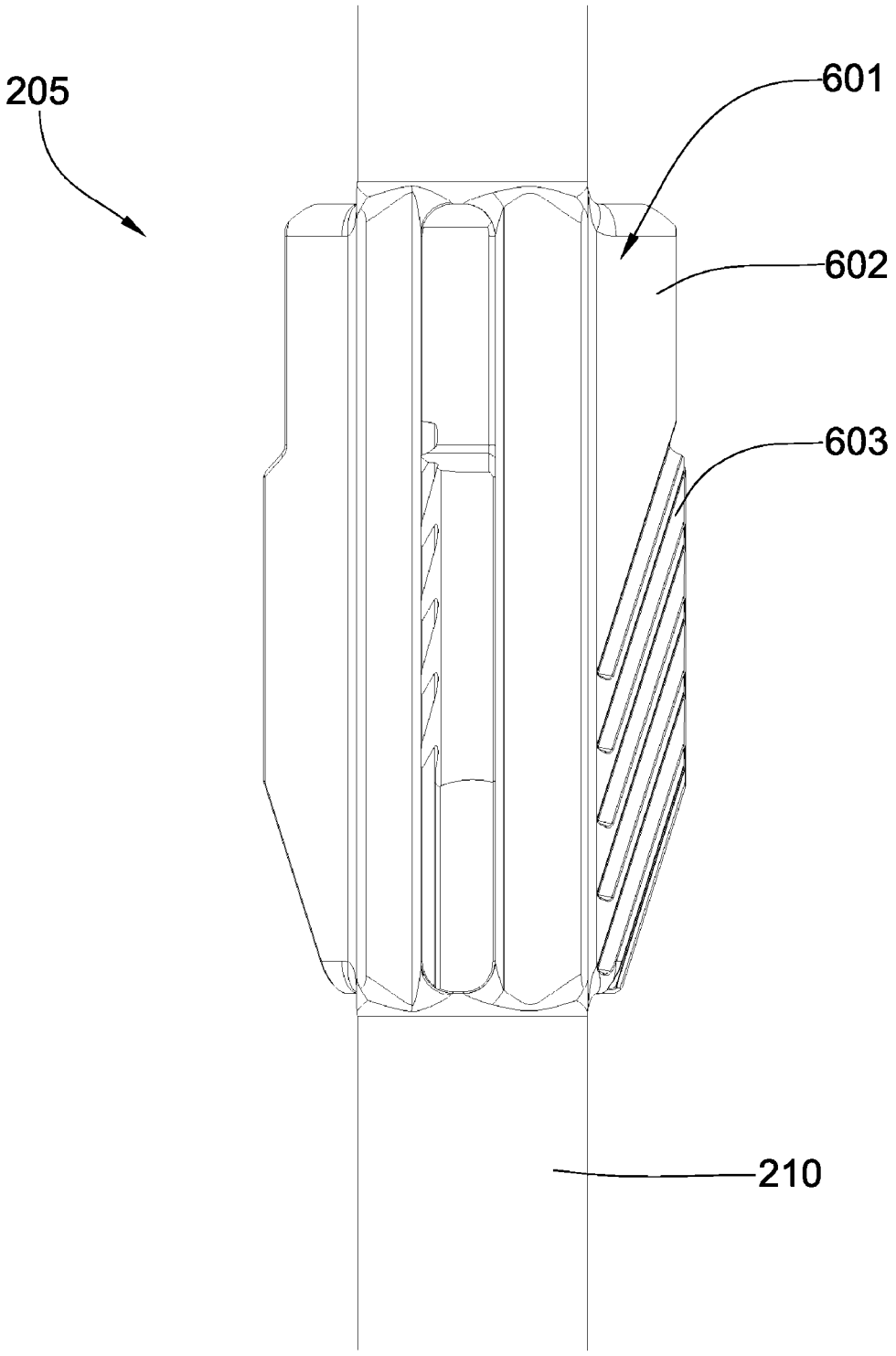
FIG. 6 is an orthogonal view of an embodiment of a mandrel.

FIG. 6 discloses an orthogonal view of an embodiment of the mandrel 205 comprising a plurality of fins 601. The plurality of fins may extend from the outer diameter 210 of the mandrel 205. At least one fin 602 of the plurality of fins 601 may comprise a plurality of channels 603. The plurality of channels 603 disposed on at least one fin 602 may mate with the plurality of channels disposed on the interior surface of at least one blade of the plurality of blades. It is believed that the mandrel 205 may increase the stiffness of the expandable tool. As stress is applied to the plurality of blades during normal drilling operations the plurality of fins 601 may act to support the plurality of blades thus increasing stiffness and efficiency and decrease the likelihood of failure.

Figure 7:
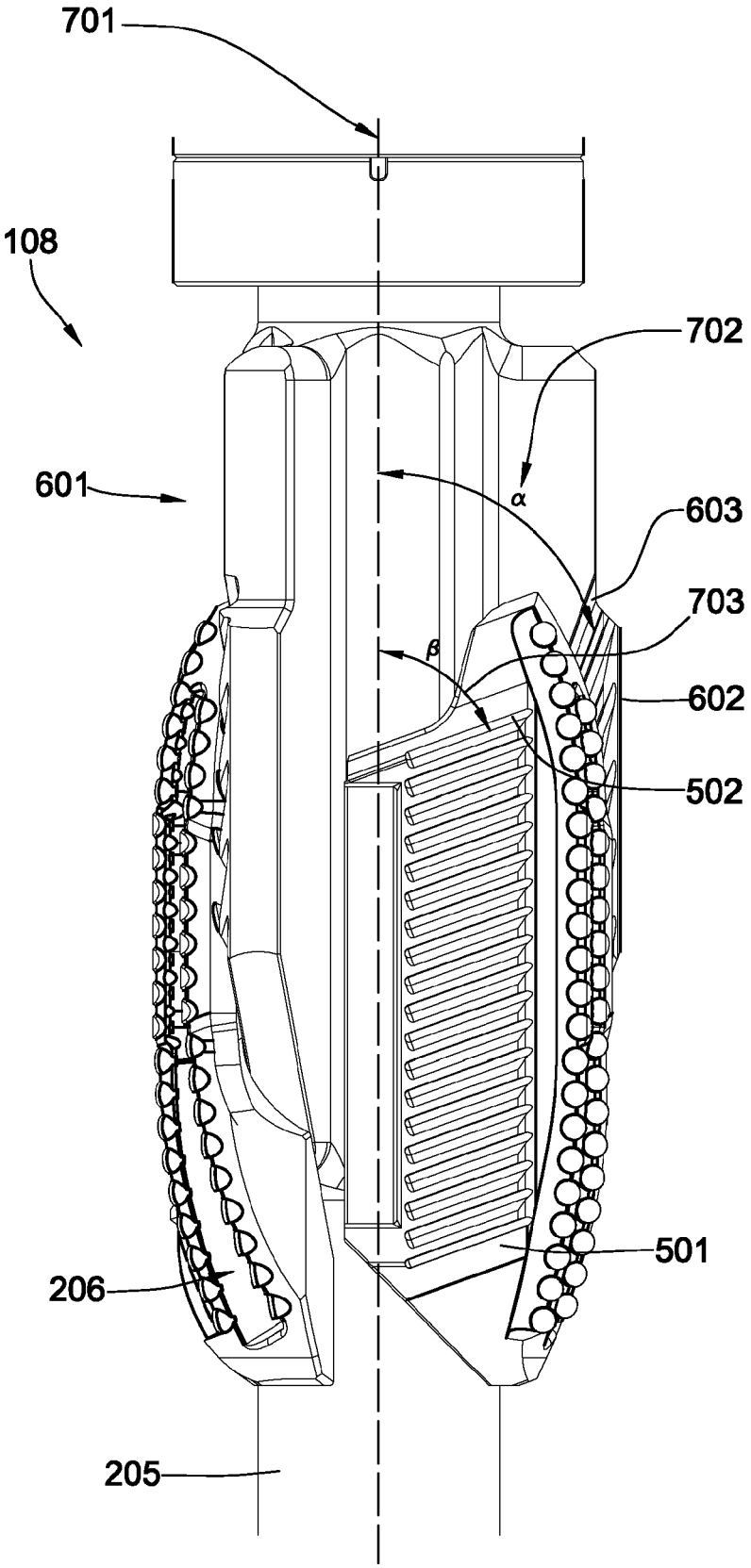
FIG. 7 is an orthogonal cutaway view of an embodiment of a downhole tool.

FIG. 7 discloses an orthogonal cutaway view of an embodiment of the downhole tool 108 with the plurality of blades 206 in a collapsed position. The plurality of channels disposed on the interior surface of at least one blade 501 of the plurality of blades 206 and the plurality of channels 603 disposed on at least one fin 602 of the plurality of fins 601 may be at angle $\alpha$ 702 which may be between 10 and 30 degrees with respect to an axis 701 of the mandrel 205. The plurality of channels disposed on the interior surface on at least one blade 501 and the plurality of channels 603 on at least one fin 602 may control the rate at which the at least one blade 501 expands axially. The plurality of channels 502 disposed on the exterior surface of at least one blade 501 and the plurality of channels disposed on the slidable sleeve may be at angle $\beta$ 703 which may be between 70 and 110 degrees with respect to an axis 701. The plurality of channels 502 on at least one blade 501 and the plurality of channels disposed on the slidable sleeve may control the rate at which the at least one blade 501 expands radially.

Figure 8:
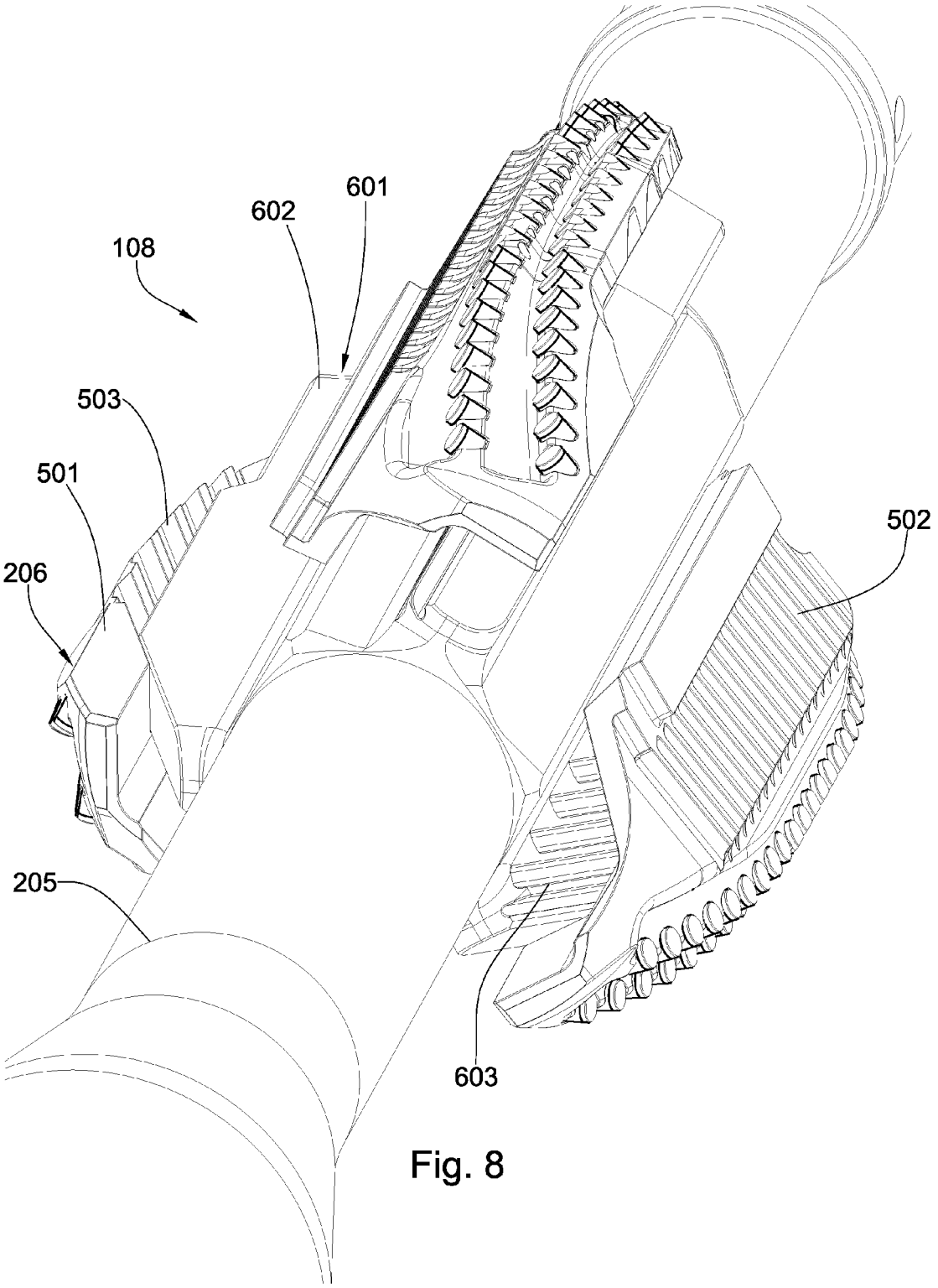
FIG. 8 is an orthogonal cutaway view of another embodiment of a downhole tool.

FIG. 8 discloses an orthogonal cutaway view of another embodiment of the downhole tool 108 with the plurality of blades 206 in an expanded position. The plurality of blades 206 may be partially wrapped around the plurality of fins 601 of the mandrel 205. A wedge may be formed between a plurality of channels 603 disposed on at least one fin 602 of the plurality of fins 601 and a plurality of channels disposed on the slidable sleeve (not shown). The plurality of channels 603 on at least one fin 602 and the plurality of channels on the slidable sleeve may be at different angles with respect to a central axis. In the embodiment shown, the slidable sleeve has been removed to clarify the positioning of the plurality of the blades 206. However, the angle with respect to a central axis of the plurality of channels on the slidable sleeve is similar to the plurality of channels 502 on at least one blade 501 of the plurality of blades 206 because the plurality of channels disposed on the slidable sleeve may mate with the plurality of channels 502. The wedge may be formed when the at least one blade 501 is expanding and cannot expand further due to the difference in angles of the plurality of channels 603 on the at least one fin 602 and the plurality of channels on the slidable sleeve. The wedge may increase the stiffness of the downhole tool 108 because the at least one blade 501 may be held in place due to the interactions between the plurality of channels 603 on at least one fin 602 with the plurality of channels 503 on the interior surface of at least one blade 501 and the interactions between the plurality of channels 502 on the exterior surface of at least one blade 501 with the plurality of channels on the slidable sleeve. Also in this embodiment, the slidable sleeve may manipulate the plurality of blades 206 by engaging the plurality of channels 503 on the interior surface of at least one blade 501 of the plurality of blades 206 with the plurality of channels 603 on at least one fin 602 of the plurality of fins 601 and engaging the plurality of channels 502 on the exterior surface of at least one blade 501 of the plurality of blades 206 with the plurality of channels on the slidable sleeve.

Figure 9:
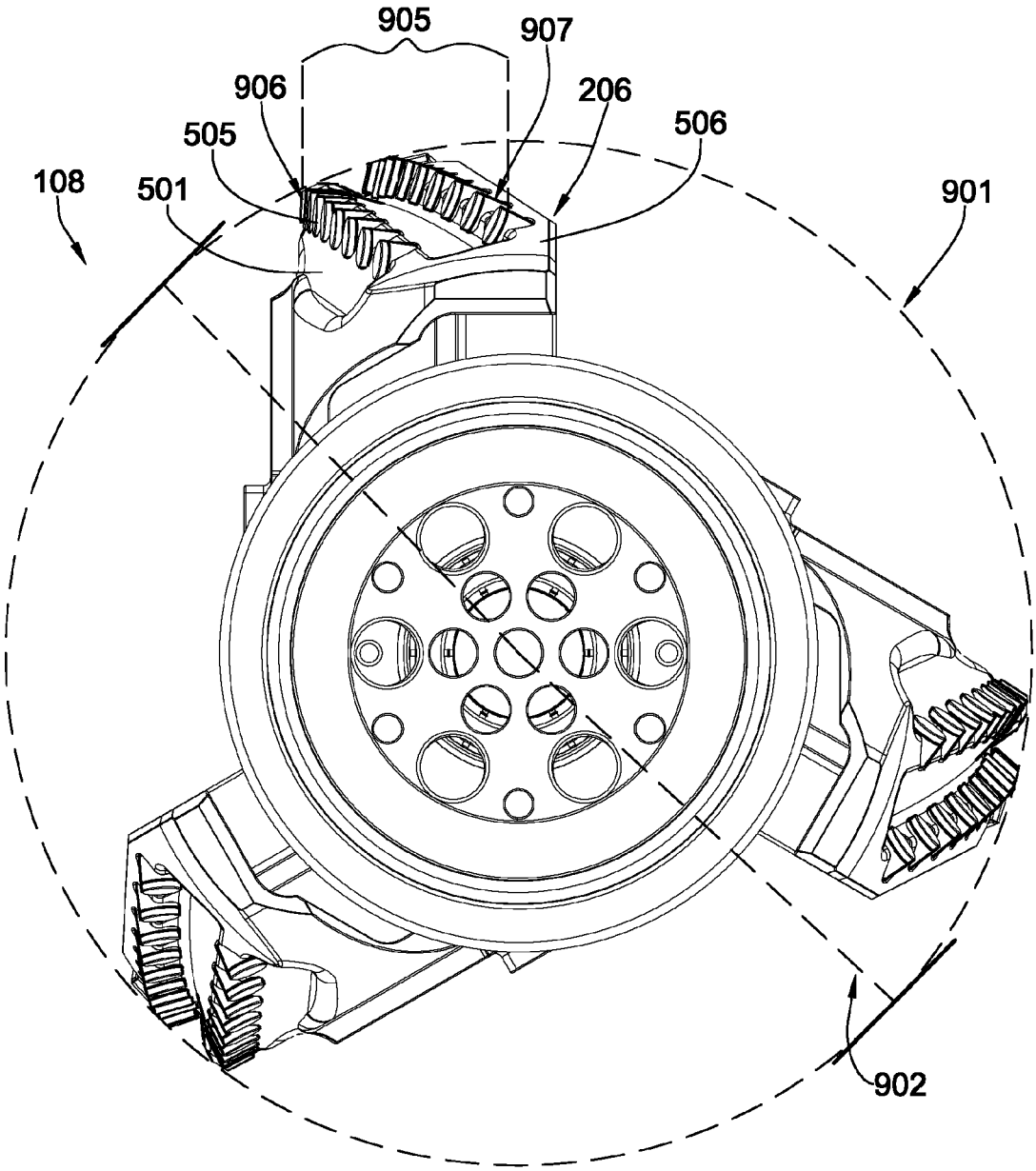
FIG. 9 is a cross-sectional cutaway view of an embodiment of a downhole tool.

FIG. 9 discloses a cross-sectional cutaway view of an embodiment of the downhole tool 108 with the plurality of blades 206 in an expanded position. The downhole tool 108 may rotate during normal drilling operations causing the plurality of blades 206 to rotate and form a circumference 901. The plurality of blades 206 may form an external diameter 902 which may increase as much as 35% from a collapsed to an expanded position, for example from 10 to 13.5 inches.

The initial impact zone 506 on at least one blade 501 of the plurality of blades 206 may allow the plurality of cutters 505 to be disposed along a swept curve. The swept curve may allow more cutters to be disposed along at least one leading edge due to an increased arc length. The plurality of cutters 505 along the swept curve within a range 905 may contact the earthen formation at the same time. The range 905 may comprise the boundaries of the last cutter 906 on a first leading edge and the first cutter 907 on a second leading edge. A larger exposed surface area of the initial impact zone 506 may allow the plurality of cutters 505 to be spaced along different leading edges on different blades of the plurality of blades 206. It is believed that placing the plurality of cutters 505 spaced along different leading edges on different blades allows the downhole tool to drill more smoothly. The downhole drill string may drill more smoothly because the plurality of cutters 505 on a first blade may not be cutting in the same grooves as the plurality of cutters 505 on a second blade.

Figure 10:
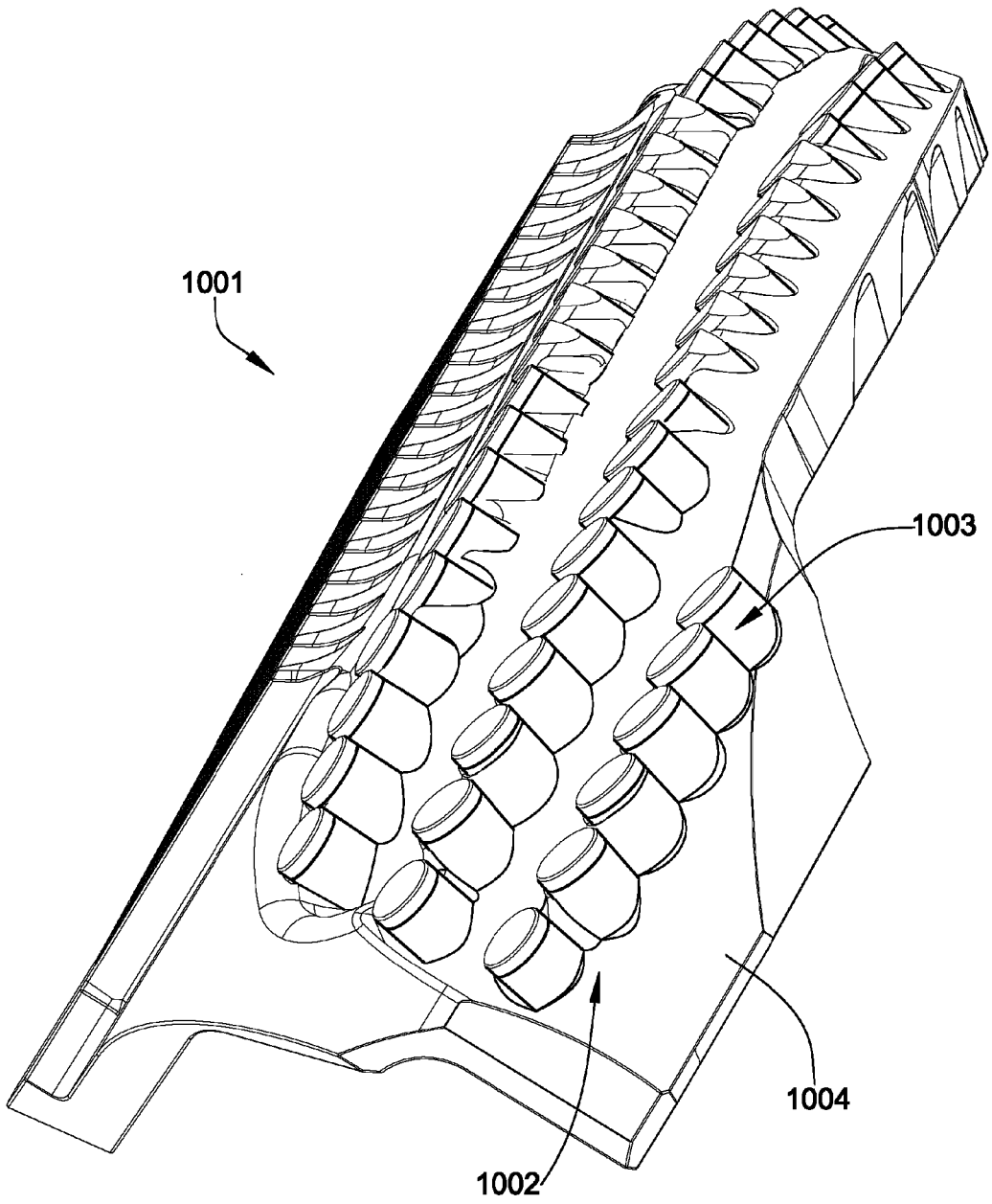
FIG. 10 is a perspective view of an embodiment of a blade.

FIG. 10 discloses a perspective view of an embodiment of at least one blade 1001 comprising an extra leading edge 1002. The extra leading edge 1002 may comprise a plurality of cutters 1003. The extra leading edge 1002 may be disposed on a larger exposed surface area of an initial impact zone 1004.

Figure 11:
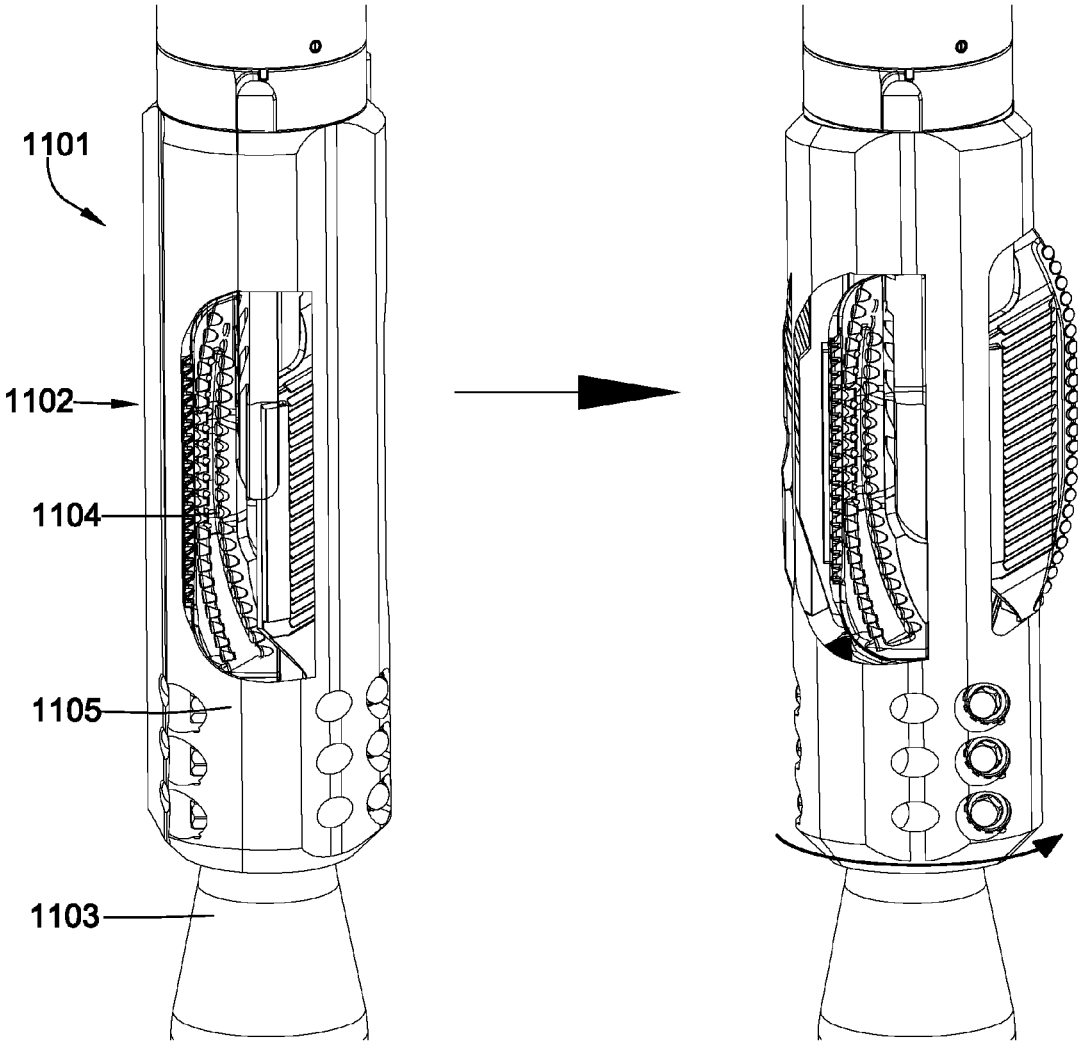
FIG. 11 is a perspective view of an embodiment of a downhole tool.

FIG. 11 discloses a perspective view of an embodiment of a downhole component 1101 comprising an expandable tool 1102. The expandable tool 1102 may comprise a mandrel 1103, a plurality of blades 1104 and a slidable sleeve 1105. The slidable sleeve 1105 may be capable of manipulating the plurality of blades 1104 into collapsed and expanded positions. The slidable sleeve may manipulate the plurality of blades 1104 by rotating around the mandrel 1103. The slidable sleeve 1105 and plurality of blades 1104 may be connected such that as the slidable sleeve 1105 rotates around the mandrel 1103, the plurality of blades 1104 move into an expanded position.

Figure 12:
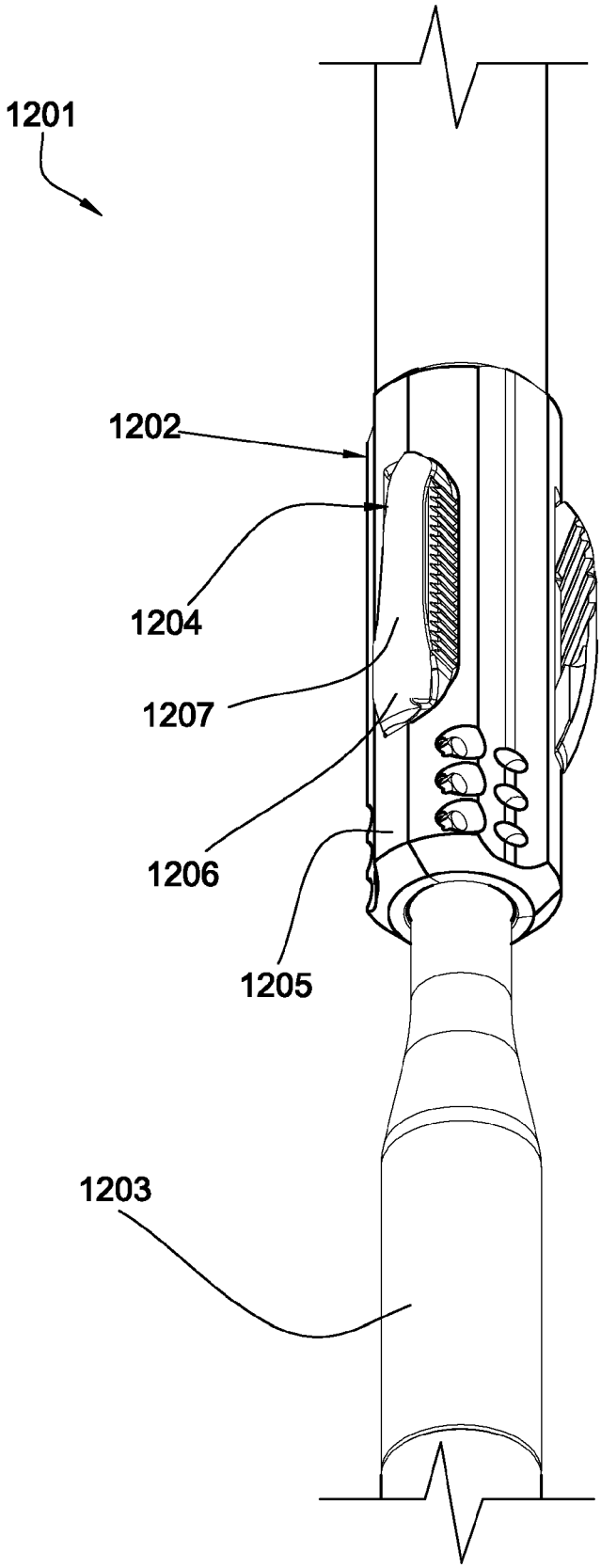
FIG. 12 is a perspective view of an embodiment of a downhole tool.

FIG. 12 discloses a perspective view of an embodiment of a downhole component 1201 comprising an expandable tool 1202. The expandable tool 1202 may comprise a mandrel 1203, a plurality of blades 1204 and a slidable sleeve 1205. At least one blade 1206 of the plurality of blades 1204 may comprise a flat edge 1207. The flat edge 1207 may engage an earthen formation to stabilize the mandrel 1203 during normal drilling operations.

Figure 13:
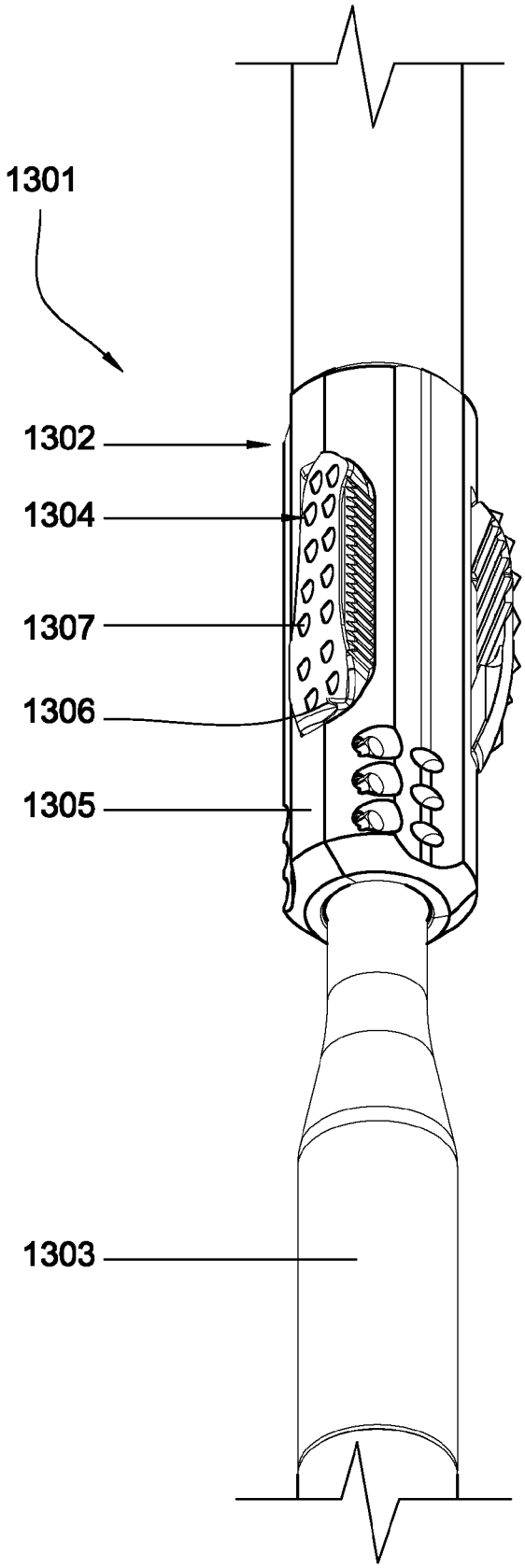
FIG. 13 is a perspective view of an embodiment of a downhole tool.

FIG. 13 discloses a perspective view of an embodiment of a downhole component 1301 comprising an expandable tool 1302. The expandable tool 1302 may comprise a mandrel 1303, a plurality of blades 1304 and a slidable sleeve 1305. At least one blade 1306 of the plurality of blades 1304 may comprise traction edges 1307. The traction edges 1307 may engage an earthen formation and immobilize the mandrel 1303 during normal drilling operations.

Whereas the present invention has been described in particular relation to the drawings attached hereto, it should be understood that other and further modifications apart from those shown or suggested herein, may be made within the scope and spirit of the present invention.

What is claimed is:

1. An expandable tool for an earth boring system, comprising:

a mandrel comprising a tubular body and an outer diameter;

a plurality of blades disposed about the outer diameter; and a slidable sleeve positioned around the outer diameter and capable of manipulating the plurality of blades into collapsed and expanded positions;

the slidable sleeve comprises a plurality of interchangeable sections which combine to form a complete toroid around the outer diameter.

2. The expandable tool of claim 1, wherein the manipulating the plurality of blades comprises translating the slidable sleeve axially along the mandrel.

3. The expandable tool of claim 1, wherein the manipulating the plurality of blades comprises rotating the slidable sleeve around the mandrel.

4. The expandable tool of claim 1, further comprising a plurality of fins extending from the outer diameter of the mandrel.

5. The expandable tool of claim 4, wherein the plurality of blades are partially wrapped around the plurality of fins.

6. The expandable tool of claim 1, wherein at least one blade of the plurality of blades comprises an initial impact zone comprising a larger exposed surface area than a subsequent impact zone.

7. The expandable tool of claim 1, wherein the plurality of blades comprise a plurality of cutters spaced along a swept curve and disposed on at least one leading edge.

8. The expandable tool of claim 7, wherein an extra leading edge is disposed on a larger exposed surface area of an initial impact zone on at least one blade of the plurality of blades.

9. The expandable tool of claim 1, wherein a plurality of channels are disposed on interior and exterior surfaces of at least one blade of the plurality of blades.

10. The expandable tool of claim 9, wherein at least one fin of a plurality of fins comprise a plurality of channels which mate with the plurality of channels disposed on the interior surface of at least one blade of the plurality of blades.

11. The expandable tool of claim 10, wherein the plurality of channels disposed on the interior surface of at least one blade of the plurality of blades and the plurality of channels disposed on at least one fin of the plurality of fins are angled between 10 and 30 degrees with respect to an axis of the mandrel in order to control the rate at which the at least one blade of the plurality of blades expands axially.

12. The expandable tool of claim 9, wherein the slidable sleeve comprises a plurality of channels which mate with the plurality of channels disposed on the exterior surface of at least one blade of the plurality of blades.

13. The expandable tool of claim 12, wherein the plurality of channels disposed on the exterior surface of at least one blade of the plurality of blades and the plurality of channels disposed on the slidable sleeve are angled between 70 and 110 degrees with respect to an axis of the mandrel in order to control the rate at which at least one blade of the plurality of blades expands radially.

14. The expandable tool of claim 9, wherein the plurality of channels on the interior and exterior surfaces of the plurality of blades comprise a buttress thread geometry.

15. The expandable tool of claim 10, wherein manipulating the plurality of blades comprises engaging the plurality of channels on the interior surface of at least one blade of the plurality of blades with a plurality of channels on at least one fin of a plurality of fins and engaging the plurality of channels on the exterior surface of at least one blade of the plurality of blades with a plurality of channels on the slidable sleeve.

16. The expandable tool of claim 1, wherein a first ridge is disposed on an interior surface of the slidable sleeve which comes into contact with a second ridge disposed on an external surface of at least one blade of the plurality of blades stopping the further expansion of at least one blade of the plurality of blades.

17. The expandable tool of claim 1, wherein at least one blade of the plurality of blades comprises a flat edge to engage an earthen formation to stabilize the mandrel.

18. The expandable tool of claim 1, wherein at least one blade of the plurality of blades comprises traction edges to engage an earthen formation and immobilize the mandrel.

19. An expandable tool for an earth boring system, comprising:

a mandrel comprising a tubular body and an outer diameter;

a plurality of blades disposed about the outer diameter; and a slidable sleeve positioned around the outer diameter and capable of manipulating the plurality of blades into collapsed and expanded positions;

wherein a plurality of channels are disposed on interior and exterior surfaces of at least one blade of the plurality of blades; and wherein a wedge is formed between a plurality of channels disposed on at least one fin of a plurality of fins and a plurality of channels disposed on the slidable sleeve when at least one blade of the plurality of blades are in an expanded position.

* * * * *